US010932629B1

(12) United States Patent
Hernandez

(10) Patent No.: US 10,932,629 B1
(45) Date of Patent: Mar. 2, 2021

(54) AUTOMATIC TOILET SEAT CLEANING DEVICE

(71) Applicant: Dani Hernandez, Naples, FL (US)

(72) Inventor: Dani Hernandez, Naples, FL (US)

( * ) Notice: Subject to any disclaimer, the term of this patent is extended or adjusted under 35 U.S.C. 154(b) by 0 days.

(21) Appl. No.: 16/747,619

(22) Filed: Jan. 21, 2020

(51) Int. Cl.
*A47K 13/30* (2006.01)
*E03D 9/00* (2006.01)

(52) U.S. Cl.
CPC ..... *A47K 13/302* (2013.01); *A47K 13/305* (2013.01); *E03D 9/002* (2013.01)

(58) Field of Classification Search
CPC ..... A47K 13/302; A47K 13/305; E03D 9/002
See application file for complete search history.

(56) References Cited

U.S. PATENT DOCUMENTS 1,512,174 A * 10/1924 Isaac ..... A47K 13/302 15/210.1
3,599,246 A * 8/1971 Bramati ..... A47K 13/302 4/233
6,772,451 B2 8/2004 Pellati
7,509,693 B1 * 3/2009 Graves ..... A47K 13/302 4/233
9,339,158 B2 5/2016 Dorra

FOREIGN PATENT DOCUMENTS

KR 10-0886979 * 3/2009

OTHER PUBLICATIONS

Machine Translation for KR10-0886979 retrieved on Dec. 28, 2020 (Year: 2020).*

* cited by examiner

*Primary Examiner* — Janie M Loeppke
(74) *Attorney, Agent, or Firm* — Sanchelima & Associates, P.A.; Christian Sanchelima; Alexander J. Rodriguez

(57) ABSTRACT

An automatic toilet seat cleaning device is disclosed herein. The bathroom hygiene device includes an automated toilet seat cleaner having a track mounted on the inside and outside edge of the toilet seat. Furthermore, the motorized cleaning device has a replaceable cleaning pad, and wheel or roller elements which are coupled to the tracks and allow the cleaning deice to move around the surface of the seat. Additionally, the toilet seat includes an integral heating element mounted to a bottom end of the toilet seat. The heating element controls the temperature of the toilet seat to maintain a comfortable temperature for a user. Furthermore, the toilet seat includes a mounting section where the device can be stored and charged when not in use.

11 Claims, 4 Drawing Sheets

AUTOMATIC TOILET SEAT CLEANING DEVICE

BACKGROUND OF THE INVENTION

1. Field of the Invention

The present invention relates to a toilet cleaning device and, more particularly, to a toilet seat cleaning device that includes a toilet seat having integral tracks along its side that is configured to provide a transportation means for a cleaning device that travels along the toilet seat.

2. Description of the Related Art

Several designs for an automatic toilet seat have been designed in the past. None of them, however, include a bathroom hygiene device comprising an automated toilet seat cleaner having a track mounted on the inside and outside edge of the toilet seat, and a motorized cleaning device having a replaceable cleaning pad, and wheel or roller elements which are coupled to the tracks and allow the cleaning deice to move around the surface of the seat. Additionally, the toilet seat includes an integral heating element mounted to a bottom end of the toilet seat. The heating element controls the temperature of the toilet seat to maintain a comfortable temperature for a user. Furthermore, the toilet seat includes a mounting section where the device can be stored and charged when not in use.

It is known that individuals always have a need to clean to the toilet seat of their bathroom. It is also known that this process may seem disgusting to some who are not willing to directly touch the toilet seat due to hygienic issues. Additionally, it is important to maintain a regularly cleaned toilet seat in order to maintain a hygienic toilet environment. Therefore, there is a need for an automatic toilet cleaning device to aid a user in maintaining a clean toilet environment. The device will automatically clean the top end of the toilet seat with little effort from a user. As a result, a user maintains a clean toilet environment.

Applicant believes that a related reference corresponds to U.S. Pat. No. 6,772,451 issued for an automatic device for washing a toilet seat ring. Applicant another related reference corresponds to U.S. Pat. No. 9,339,158 issued for an auto cleaning toilet seat. However, these references differ from the present invention because they fail to disclose a bathroom hygiene device comprising an automated toilet seat cleaner having a track mounted on the inside and outside edge of the toilet seat, and a motorized cleaning device having a replaceable cleaning pad, and wheel or roller elements which are coupled to the tracks and allow the cleaning deice to move around the surface of the seat. The present invention addresses all of these issues and further includes an integrated heating element on a bottom end of the toilet seat to maintain a comfortable temperature for a user.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide an automatic toilet seat cleaning device that maintains a clean toilet environment provides a user with a high quality of hygiene when using a toilet.

It is another object of this invention to provide an automatic toilet seat cleaning device wherein the toilet seat includes an integrated heating element to maintain the toilet seat at a comfortable temperature for a user.

It is still another object of the present invention to provide an automatic toilet cleaning device having a motorized cleaning pad attachment to effectively clean the top portion of a toilet seat.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
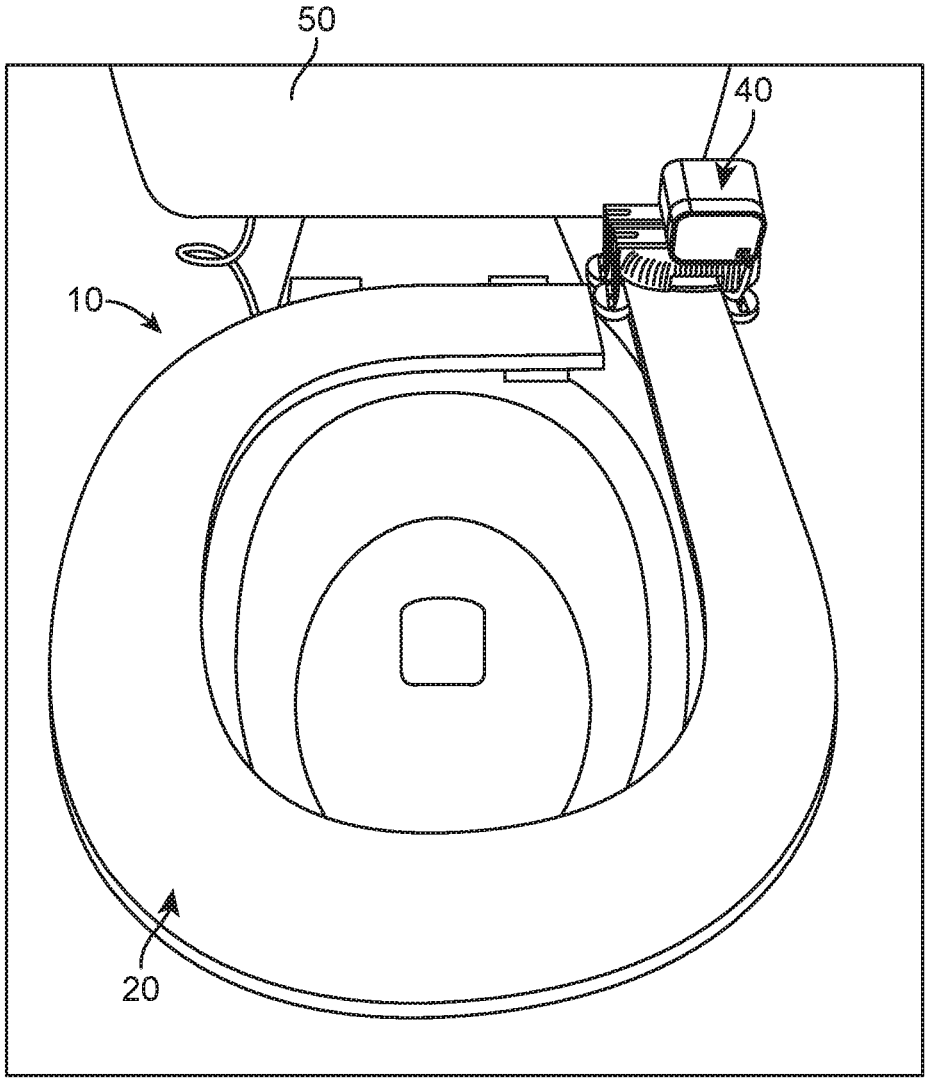
FIG. 1 represents an isometric view of an automatic toilet seat cleaning device 10 in its operating environment in accordance to an embodiment of the present invention.

Referring now to the drawings, where the present invention is generally referred to with numeral 10, it can be observed an automatic toilet seat cleaning device 10 having a seat assembly 20 and a cleaning assembly 40.

Figure 2:
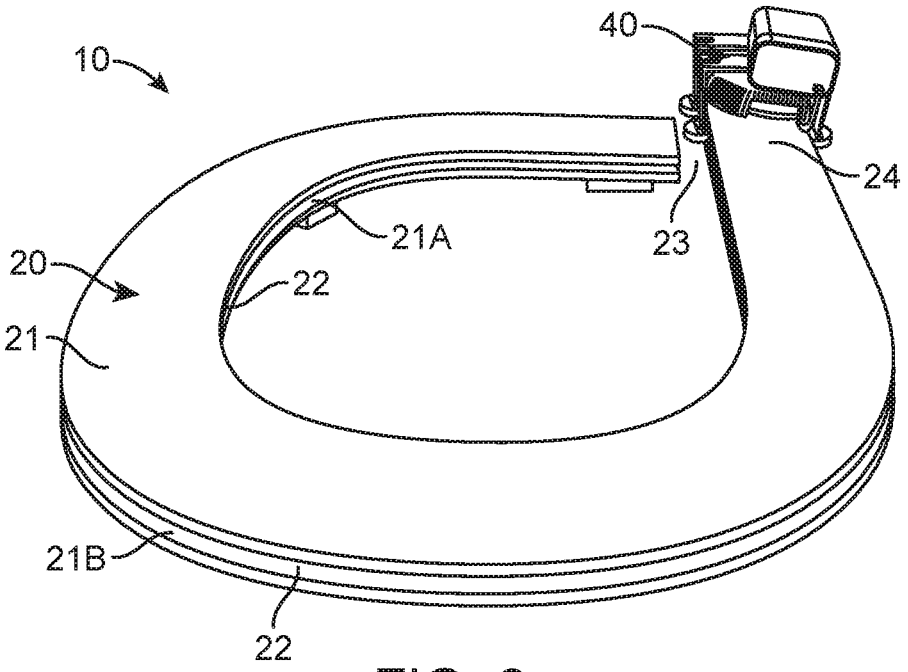
FIG. 2 shows an isometric top view of seat assembly 20 in accordance to an embodiment of the present invention.

Seat assembly 20 includes a toilet seat 21 having an inside edge 21A and an outside edge 21B. In one embodiment, toilet seat 21 may resemble a toilet seat that is found on traditional toilet seat. In another embodiment, as depicted in FIG. 2, toilet seat 21 may be a modified toilet seat that is best configured to receive cleaning assembly 40. Toilet seat 21 may be mounted onto a toilet 50 that may be found within a user's home. Inside edge 21A represents the sidewalls along the inner side of the toilet seat and outer edge 21B may represent the sidewalls along the outer side of the toilet seat. Both edges may include a track 22 mounted therein. In one embodiment, as seen in FIG. 2, track 22 may be an inner channel opening extending within inside edge 21A and outer edge 21B a predetermined amount. Other embodiments may include a metal track that is stored within the inner channel opening. However, a metal track is not necessary for the invention to operate in the present embodiment. Additionally, toilet seat 21 may include a first end and a second end having a space 23 separating both openings. As seen in FIG. 2, the space 23 is necessary for the cleaning assembly 40 to be able to travel along toilet seat 21.

Figure 5:
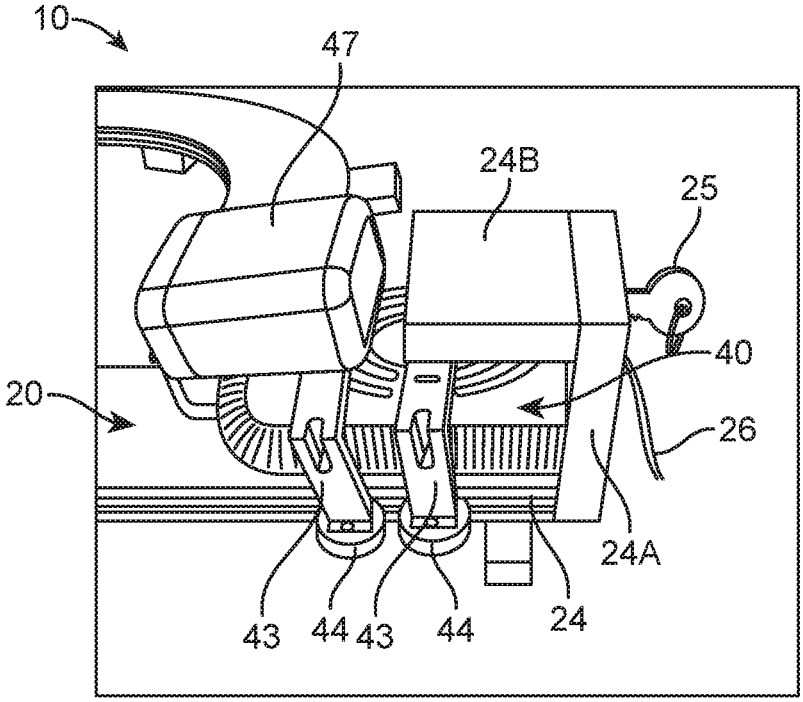
FIG. 5 shows a side view of cleaning assembly 40 mounted onto seat assembly 20 in accordance to an embodiment of the present invention.
Figure 6:
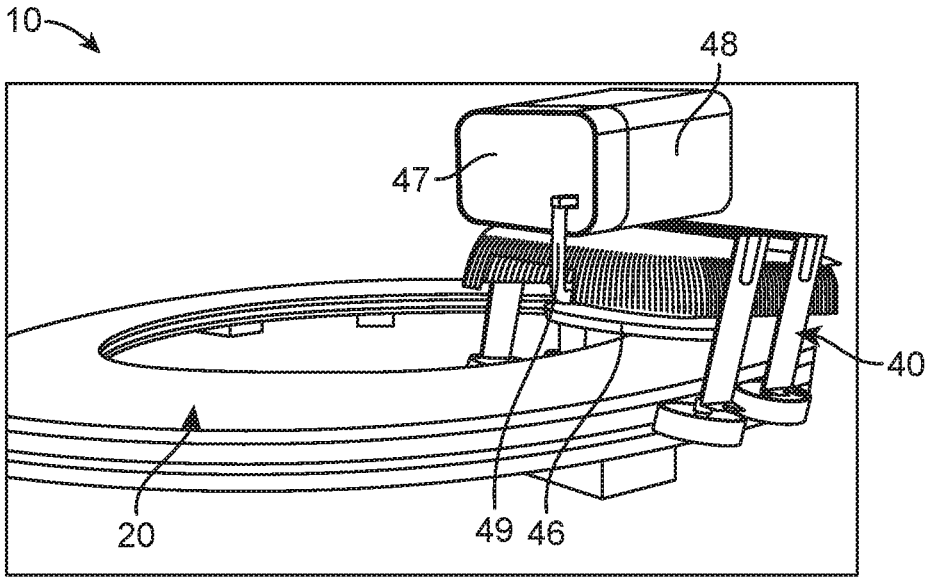
FIG. 6 illustrates an isometric view of cleaning assembly 40 traveling along seat assembly 40 in accordance to an embodiment of the present invention.

Toilet seat 21 may further include a mounting portion 24 including a vertical sidewall 24A and a roof cover 24B. In one embodiment, as observed in FIG. 5, mounting portion 24 may be located on a second end of toilet seat 21. Mounting portion 24 provides a suitable storing means for cleaning assembly 20 when not in use. Vertical sidewall 24A is a rectangular sidewall that is attached to a further most end of toilet seat 21. Additionally, roof cover 24B may be a horizontal rectangular sidewall that is hingedly mounted to the top end of vertical sidewall 24A. In one embodiment, vertical sidewall 24A may have a suitable height to entirely receive cleaning assembly 40 therein. Furthermore, roof cover 24B may extend the entire length of cleaning assembly 40 or may partially extend across cleaning assembly 40. Vertical sidewall 24A may further include a key 25 mounted within a back end. Furthermore, vertical sidewall 24A may include wires 26 extending thereout. In one embodiment, wires 26 are communicably connected to a power source. This power source may be a wall outlet, or a battery located near toilet 50. Additionally, a user may actuate key 25 provided in order to actuate cleaning assembly 40 housed within mounting portion 24. Other embodiments may include a wireless communication module housed within vertical sidewall 24A to allow cleaning assembly 40 to be wirelessly activated. In this embodiment, a user may use a mobile device in order to actuate the cleaning assembly 40 to then travel along toilet seat 21. It should also be understood, that key 25 is not limited to being a metal key as depicted in FIG. 5, and may be in the form of button or any other suitable actuation member.

Figure 3:
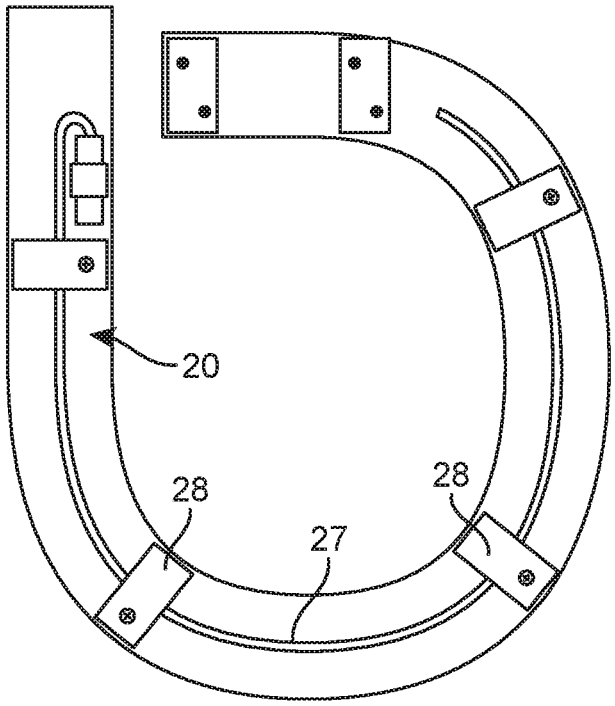
FIG. 3 illustrates an isometric bottom view of seat assembly 20 in accordance to an embodiment of the present invention.

Toilet seat 21 may further include an integrated heating element 27 mounted to a bottom end of toilet seat 21. In one embodiment, integrated heating element 27 is a temperature-controlled metal wire that is recessed within the bottom end of toilet seat 21. As seen in FIG. 3, integrated heating element 27 may be seen extending partially along the bottom end of toilet seat 21. Other embodiments, mat include integrated heating element 27 extending entirely along the bottom end. Additionally, the temperature of integrated heating element 27 may be a predetermined temperature that is set by a user. As user may set the integrated heating element 27 to be actuated once key 25 is actuated. In one embodiment, a user may utilize a wireless communication module to control the temperature of integrated heating element 27. Integrated heating element may be used to keep toilet seat 21 at a suitable comfortable temperature ranging from but not limited to 70-80 degrees. Additionally, integrated heating element 27 may be secured to toilet seat 21 through mounting members 28. Mounting members 28 may be rectangular mounting members extending across integrated heating element 27. Additionally, mounting members 28 may be locked into toilet seat 21 through means of threaded fasteners. It should be understood that other mounting means may be used to secure integrated heating element 27 such as but not limited to adhesives and hook and loop fasteners. Seat assembly 20 provides automatic toilet seat cleaning device 10 the necessary configuration to effectively be used with cleaning assembly 40.

Figure 4:
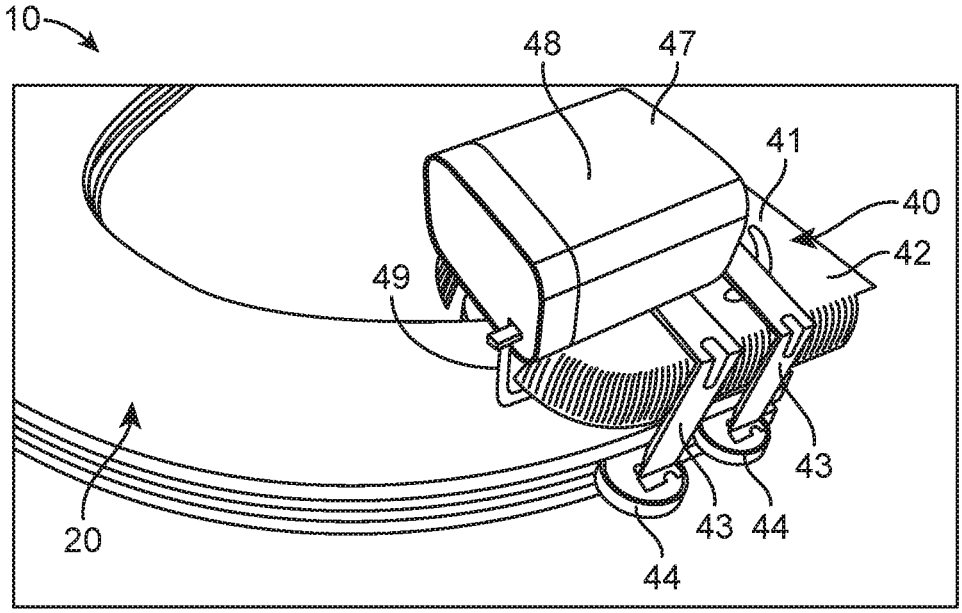
FIG. 4 is a representation of an isometric view of cleaning assembly 40 in accordance to an embodiment of the present invention.

Cleaning assembly 40 includes a cleaning device 41 having an enclosure 42. In one embodiment, as observed in FIG. 4, enclosure 42 may be a rectangular enclosure having vertical sidewalls and a circular sidewall. Additionally, other shapes of enclosure 42 may be provided such as but not limited to a uniform square shape or a uniform circular shape. Additionally, enclosure 42 may further include apertures located long a top side and vertical sidewalls of enclosure 42. These apertures may come in the form of circular openings or vertical openings along enclosure 42. Furthermore, cleaning assembly 40 includes mounting brackets 43 extending on across the top end of enclosure 42. Mounting brackets 43 may be in the form of "U" shaped metal brackets that extend beneath the sidewalls of the enclosure. As seen in FIG. 5, two sets of mounting brackets 43 are provided in one embodiment of the present invention 10. However, multiple brackets may be included and it should be understood that enclosure should be provided with at least one of mounting brackets 43. Additionally, a bottom end of mounting brackets 43 may be provided with roller elements 44. In one embodiment, roller elements 44 are wheels that are mounted in horizontal configuration thereon a bottom end of mounting brackets 43. Furthermore, roller elements 44 are then inserted within inner channel of track 22. Roller elements 44 are additionally communicably attached to track 22 of seat assembly 20. It should be understood that roller elements 44 is not suitable to being just a wheel but may be any suitable transportation element that is received by track 22.

Figure 7:
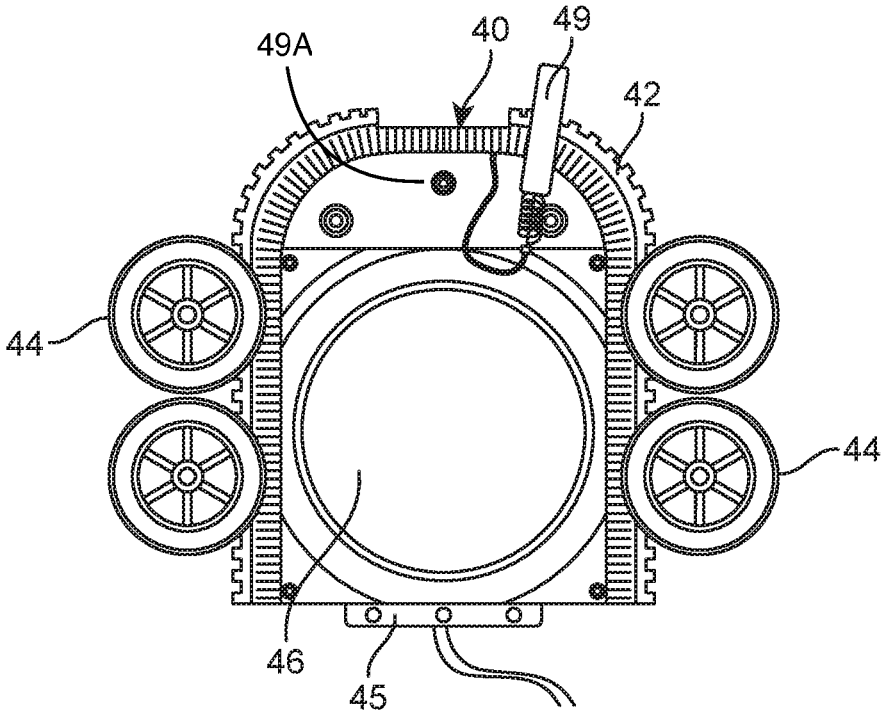
FIG. 7 represents an isometric bottom view of cleaning assembly 40 in accordance to an embodiment of the present invention.

Cleaning assembly 40 further includes a motor 45 communicably connected to a cleaning pad 46 and roller elements 44. Additionally, Cleaning assembly 40 may be provided with more than one motor 45. In one embodiment, two motors are provided for cleaning assembly 40. One motor may be used to power roller elements 44. The other motor may be used to enable the rotation of cleaning pad 46 as it travels along the top of the toilet seat 21. In one embodiment, as seen in FIG. 7, cleaning pad 46 may be located on a bottom end of enclosure 42. Cleaning pad 46 may be a circular cleaning pad that is designed to be replaceable such that a clean cleaning pad may be provided to the cleaning system every so often. It should be understood, cleaning pad 46 must be of a suitable diameter to cover the necessary surface area to be able to clean a top surface of toilet seat 21. Once motor 45 is actuated it then actuates cleaning pad 46 to then radially spin. As a result, cleaning pad 46 performs a rotating motion as it travels along the surface area of toilet seat 21 thereby providing an efficient cleaning means. Motor 45 further actuates roller elements 44 to perform a rotating motion. As a result, roller elements 44 then travel along track 22 and moves along the entire length of toilet seat 21. In one embodiment, motor 45 may be coupled to one set of roller elements 44 of mounting brackets 43. Additionally, motor 45 may be coupled to each of the roller elements provided for automatic toilet seat cleaning device 10. The mounting method may depend on the user and how the cleaning device 41 travels along toilet seat 21.

Cleaning assembly 40 further includes a container 47 housing cleaning fluid 48 therein. Container 47 may be mounted to a top end of enclosure 42 using known means in the art such as fasteners and adhesives. Additionally, container 47 may be in the form of a cubic rectangular container having a cover that extends outwardly from a front end of enclosure 42. Container 47 may be continuously refilled with cleaning fluid 28. In one embodiment, cleaning fluid 48 is a sanitizing liquid that is configured to kill germs when it is applied to a surface. It should be understood, cleaning fluid 48 may be any suitable cleaning liquid or gel contained within container 47. Additionally, container 47 includes a pump 49 attached to a front end of container 47. Pump 49 may be made of any suitable hardware that enables the spraying of water. Pump 49 further extends to bottom end of enclosure 42 and extends up to hose attachment 49A. In one embodiment, hose attachment 49A continuously supplies cleaning pad 46 with cleaning fluid 48 stored within container 47. Cleaning fluid 48 is applied to cleaning pad 46 as it travels along toilet seat 21. As a result, cleaning pad 46 provides toilet seat 21 with an effective cleaning and sanitation means.

In the present embodiment, cleaning assembly 40 is stored within mounting portion 24 when not in use. When a user desires to clean toilet seat 21 he will then actuate key 25 to actuate the cleaning system. Motor 45 is then engaged and as a result, roller elements 44 then begin to move cleaning device 41 along track 22. Additionally, cleaning pad 46 then begins to turn and clean toilet seat 21 as cleaning device 41 travels along the entire surface area of toilet seat 21. As cleaning device 41 is moving, hose attachment 49A supplies cleaning pad 46 with cleaning fluid 48 from container 47 to provide an effective sanitation means. Once the system is engaged, integrated heating element 27 is further engaged in order to maintain toilet seat 21 at a comfortable temperature for a user. Automatic toilet seat cleaning device 10 provides a user with the most effective method to clean the seat of a toilet.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a bathroom hygiene device, comprising:

a. a seat assembly including a toilet seat having a track located on an inside edge and an outside edge of said toilet seat, wherein said track is an inner channel extending within said inside edge and said outside edge of said toilet seat a pre-determined amount wherein said toilet seat includes a first end and a second end having a space between said first end and said second end, wherein said second end includes a mounting portion including a vertical sidewall and a roof cover, wherein said vertical sidewall includes a key inserted within, wherein said vertical sidewall further includes wires attached to a power source; and b. a cleaning assembly including a motorized cleaning device having a replaceable cleaning pad and roller elements which are coupled to said track, wherein said roller elements allow said motorized cleaning device to travel around a surface of said toilet seat, wherein said motorized cleaning device includes an enclosure being rectangular and having a circular sidewall, wherein said enclosure includes apertures along a top end and sidewalls, wherein said enclosure includes mounting brackets extending across said top end and said sidewalls, wherein said brackets include said roller elements attached thereon, wherein said enclosure further includes a motor therein communicably attached to said replaceable cleaning pad and said roller elements, said replaceable cleaning pad being a circular cleaning pad located on a bottom end of said enclosure, wherein said replaceable cleaning pad turns radially when said motor is engaged, wherein said replaceable cleaning pad cleans an upper portion of said toilet seat as said motorized cleaning device travels along said track, wherein a user may turn said key to actuate said motorized cleaning device.

2. The system for a bathroom hygiene device of claim 1 wherein said seat assembly is mounted onto a toilet within a user's home.

3. The system for a bathroom hygiene device of claim 1 wherein said roof cover is hingedly attached to said vertical sidewall.

4. The system for a bathroom hygiene device of claim 1 wherein said track extends along the entirety of said inside edge and said outer edge.

5. The system for a bathroom hygiene device of claim 1 wherein said toilet seat further includes a bottom end having an integrated heating element.

6. The system for a bathroom hygiene device of claim 5 wherein said integrated heating element is a temperature-controlled metal wire recessed within said bottom end of said toilet seat.

7. The system for a bathroom hygiene device of claim 6 wherein said bottom end further includes rectangular mounting members threadably attached to said bottom end and extending across said integrated heating element.

8. The system for a bathroom hygiene device of claim 1 wherein said enclosure further includes a container housing cleaning fluid attached to said top end of said enclosure.

9. The system for a bathroom hygiene device of claim 8 wherein said container is a cubic-rectangular container having a pump on a front portion of said container.

10. The system for a bathroom hygiene device of claim 9 wherein said pump extends to said bottom end of said enclosure and is connected to a hose attachment, said hose attachment spraying said cleaning fluid onto said replaceable cleaning pad.

11. A system for a bathroom hygiene device, comprising:

a. a toilet within a user's home;

b. a seat assembly including a toilet seat attached to said toilet having a track located on an inside edge and an outside edge of said toilet seat, wherein said track is an inner channel extending within said inside edge and said outside edge of said toilet seat a pre-determined amount, wherein said track extends along the entirety of said inside edge and said outer edge, wherein said toilet seat includes a first end and a second end having a space between said first end and said second end, wherein said second end includes a mounting portion including a vertical sidewall and a roof cover, wherein said roof cover is hingedly attached to said vertical sidewall, wherein said vertical sidewall includes a key inserted within, wherein said vertical sidewall further includes wires attached to a power source, wherein said toilet seat further includes a bottom end having an integrated heating element, wherein said integrated heating element is a temperature-controlled metal wire recessed within said bottom end of said toilet seat, wherein said bottom end further includes rectangular mounting members threadably attached to said bottom end and extending across said integrated heating element; and c. a cleaning assembly including a motorized cleaning device having a replaceable cleaning pad and roller elements which are coupled to said track, wherein said roller elements allow said motorized cleaning device to travel around the surface of said toilet seat, wherein said motorized cleaning device includes an enclosure being rectangular and having a circular sidewall, wherein said enclosure includes apertures along a top end and sidewalls, wherein said enclosure includes mounting brackets extending across said top end and said sidewalls, wherein said brackets include said roller elements attached thereon, wherein said enclosure further includes a motor therein communicably attached to said replaceable cleaning pad and said roller elements, said replaceable cleaning pad being a circular cleaning pad located on a bottom end of said enclosure, wherein said replaceable cleaning pad turns radially when said motor is engaged, wherein said replaceable cleaning pad cleans an upper portion of said toilet seat as said motorized cleaning device travels along said track, wherein said enclosure further includes a container housing cleaning fluid attached to said top end of said enclosure, wherein said container is a cubic-rectangular container having a pump on a front portion of said container, wherein said pump extends to said bottom end of said enclosure and is attached to a hose attachment, said hose attachment spraying said cleaning fluid onto said replaceable cleaning pad, wherein a user may turn said key to actuate said motorized cleaning device.

* * * * *